United States Patent [19]
Cohen et al.
[11] Patent Number: 4,478,711
[45] Date of Patent: Oct. 23, 1984

[54] METHOD AND APPARATUS FOR SEPARATING DRY MAGNETIC MATERIAL

[75] Inventors: Enrico Cohen, Northwood; Jeremy A. Good, London, both of England

[73] Assignees: Imperial College of Science & Technology; Cryogenic Consultants Ltd., both of London, England

[21] Appl. No.: 396,647

[22] Filed: Jul. 9, 1982

Related U.S. Application Data

[63] Continuation of Ser. No. 195,789, Oct. 10, 1980, abandoned.

[30] Foreign Application Priority Data

Oct. 12, 1979 [GB] United Kingdom ..... 7935428

[51] Int. Cl.[3] ..... B03C 1/14

[52] U.S. Cl. ..... 209/39; 209/150; 209/223 A; 209/232; 209/478; 209/214

[58] Field of Search ..... 209/39, 40, 150, 214, 209/222, 223 R, 223 A, 232, 478; 210/222, 223, 695

[56] References Cited

U.S. PATENT DOCUMENTS

| | | | |
|---|---|---|---|
| 2,003,141 | 5/1935 | Dorfan | 209/150 |
| 2,652,925 | 9/1953 | Vermeiren | 210/222 |
| 3,279,602 | 10/1966 | Kottenstette et al. | 209/214 |
| 3,608,718 | 9/1971 | Aubrey et al. | 209/214 |
| 3,966,590 | 6/1976 | Boom et al. | 209/214 |
| 3,984,309 | 10/1976 | Allen et al. | 209/214 |
| 4,239,619 | 12/1980 | Aplan et al. | 209/214 |

FOREIGN PATENT DOCUMENTS

| | | | |
|---|---|---|---|
| 46595 | 3/1963 | Poland | 209/224 |
| 655432 | 4/1979 | U.S.S.R. | 209/39 |

*Primary Examiner*—David Lacey
*Attorney, Agent, or Firm*—Wood, Herron & Evans

[57] ABSTRACT

The invention relates to separators for separating relatively magnetic particles from relatively non-magnetic particles in the dry state. The method of the invention involves allowing a mixture of the particles to flow past a magnet, preferably a high strength magnet, which is so arranged as to produce a strong magnetic field in a radial direction, the radial component greatly exceeding the axial component and the axial component exerting a force which is preferably substantially less than that of gravity. In this way, the magnetic particles are diverted towards the magnet but not retained by it while the non-magnetic particles continue in their original path.

14 Claims, 5 Drawing Figures

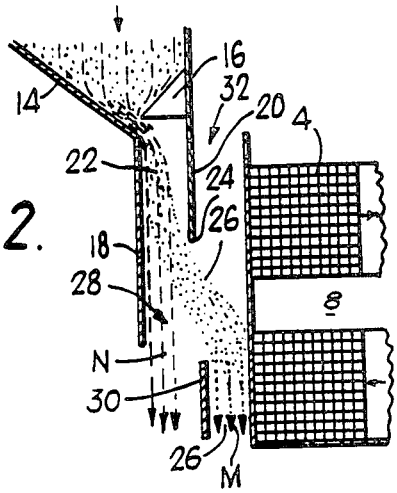
Fig. 2.
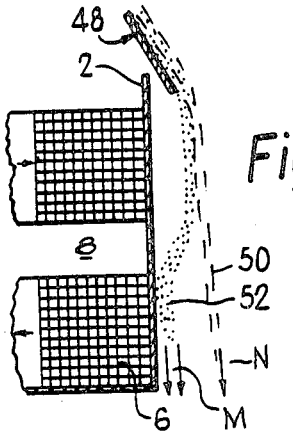
Fig. 5.
Fig. 3.
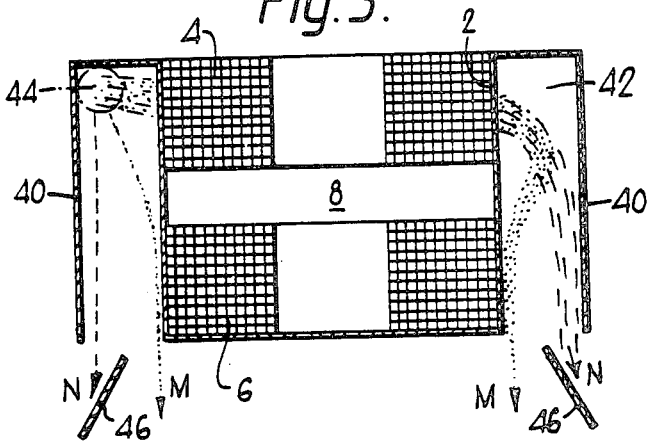
Fig. 4.
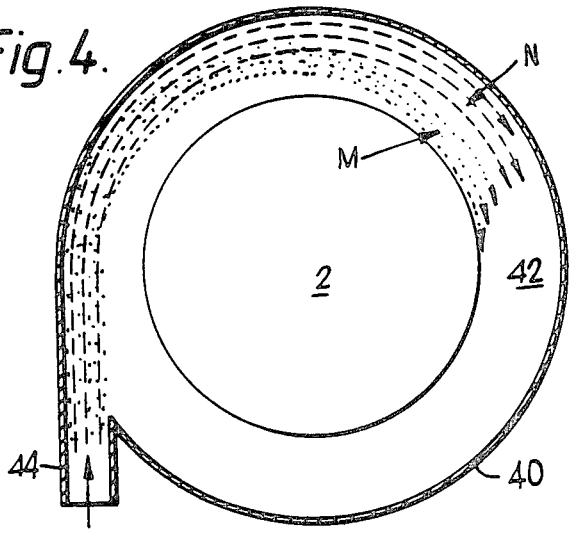

METHOD AND APPARATUS FOR SEPARATING DRY MAGNETIC MATERIAL

This is a continuation of application Ser. No. 195,789, filed Oct. 10, 1980, now abandoned.

This invention relates to separators for separating relatively magnetic particulate material from relatively non-magnetic particulate material.

Hitherto, magnetic separators for dry particulate material have been expensive and complicated in construction. To prevent trapping non-magnetic material in the magnetic product, the ore must be spread out into a thin layer, a typical example of which is the dry roll magnetic separator.

A method of separating relatively magnetic particles from relatively non-magnetic particles in the dry state in accordance with this invention comprises causing or allowing, a mixture of the magnetic and non-magnetic particles to flow in a three-dimensional stream in a common path adjacent to a magnet, preferably a high strength magnet, i.e. one having a field strength of above 20,000 gauss, and which is preferably cylindrical, the magnet being so arranged as to produce a strong magnetic field component in a radial direction, the radial component exceeding the axial component and the axial component exerting a force which is less than that of gravity, preferably substantially less, the magnetic particles then being diverted towards the magnet but not retained by it, while the non-magnetic particles continue in their original path. The magnetic particles, while being diverted from their original path, are able to continue to move in an axial direction relative to the magnet due to the fact that the axial component exerts a force small compared to gravity and the inertia of the particle.

In the new process, a more efficient separation can be carried out at high throughput rates. The process takes place with a three-dimensional stream of ore as opposed to the two-dimensional stream used in a dry roll separator.

Preferably, material to be treated falls under the influence of gravity past the magnetic member, the material then being split into two streams, one of magnetic and one of non-magnetic particles for separate collection beneath the magnet.

Separation can be carried out by allowing free fall of the material as mentioned above or, by causing or assisting the flow by suction or air pressure in which case the separation can take place in a horizontal plane.

Preferably, the mixture of magnetic and non-magnetic material is allowed to fall for a significant distance which, depending on the particle size, shape and density and the magnetic field strength, is such as to enable the particles to enter the radial magnetic field with the maximum velocity compatible with the magnet being able to divert the magnetic particles a distance at least equal to their mean diameter. This should enable the particles to move separately in parallel paths. As an example, particles having a size of about 1 to 2 mm. should fall in a band of about 4 mm. wide for a distance of about 33 cms., giving a velocity of between about 300 to 1400 cm./sec., depending, inter alia, on the material, shape and size of the particles.

The magnet may be in the form of a coil or coils, and the material may flow down either within or outside the coils. Alternatively, the magnet may be in the form of two discs of permanent magnetic material.

A magnetic separator for carrying out the above method and in accordance with the invention, comprises a magnet so arranged and designed as to produce a radial magnetic field component large compared with the axial field component and means for supplying a mixture of magnetic and non-magnetic particulate material in a three-dimensional path adjacent the magnet, the arrangement being such that as the material moves along its path under the influence of gravity and/or an applied force, the magnetic particles are diverted from their original path towards the magnet whereas the non-magnetic particles continue substantially in their original path. A path splitting device may be provided further to cause the streams of magnetic and non-magnetic material to diverge.

Preferably, the unseparated material is supplied above the magnet, the material then falling down past the magnet under the influence of gravity. The path can either be linear over a sector of an annular magnet or the material may be urged to flow in a spiral path around and down an annular magnet. In the latter case, the separation is enhanced by the effect of centrifugal force which tends to urge the non-magnetic particles out away from the magnet and away from the magnetic particles and this is particularly suitable for small particles where the effect of gravity may not be sufficient to provide adequate throughput rates.

The arrangement of the magnetic member to produce substantially only a radial field may be achieved by providing two or more vertically arranged magnetic coils arranged symmetrically about the centre line of the system but preferably, the magnet member comprises at least two co-axial coils, one positioned horizontally above the other and wound in opposite directions. Alternatively, two discs of permanent magnetic material may be used, the fields being in opposition. This results in a strong magnetic field acting in a radial direction between the two coils or discs. The region of high magnetic field extends beyond the space between the coils along both their inner and outer surfaces. Separation of particles travelling in a substantially vertical direction can take place on both the inner and outer surfaces of the windings. In order that the non-magnetic material may be fully separated from the magnetic material, the incoming stream of ore may be constrained or deflected by a plate or the like so that its path diverges at a small angle from the axis of the magnet; this helps to carry the non-magnetic material away from the surface of the magnet and the magnetic fraction.

The separator may include a hopper or the like for the mixture of magnetic and non-magnetic particles located above the magnetic coils. The hopper preferably has a conical configuration, adjacent the output, one portion of the cone may form an adjustable choke to control the flow rate, and which preferably terminates in an orifice provided with inner and outer guide skirts to control the shape and direction of the particle stream flowing through the orifice. The guide skirts are preferably parallel (but may diverge at an angle of up to 5° in the direction of particle movement) and preferably extend for a distance of about three times the diameter of the outlet orifice. For example, if the particles have a size of from 1 to 2 mm., the orifice diameter may be 5 to 10 mm., and the skirt length about 15 to 30 mm.

In order to obtain high throughput rates, the stream of ore must have thickness in a radial direction around the magnet and for efficient separation, be composed of a relatively low-density, fast-flowing stream of particles. In some cases, reduction of the air pressure is of considerable assistance with the separation of small-size particles.

The result of providing substantially only a radial field is that magnetic particles are diverted from their original path towards the magnetic member but are not prevented from falling or moving past the magnetic member. This is due to the low level of the axial component of the magnetic field gradient.

In order to produce a high strength magnetic field, it is preferred to use superconductive magnets. Normal copper coils can be used for lower strength applications.

As an example, two oppositely wound horizontally disposed superconductive magnetic coils each having an outside diameter of 35 cms., an inner diameter of 29 cms., and a thickness of 9 cms., may be used with the coils separated vertically by a distance of 3.5 cms. Such an arrangement would be suitable for particles of any material up to about 10 mm. in size, depending on the mass and magnetic susceptibility characteristic of the material.

As an example of what is meant by a high strength magnet, the radial field strength of the above magnet could be about 35,000 gauss at the gap between the coils on the outside of the coils, and 75,000 gauss within the coils.

The invention will now be described by way of example with reference to the accompanying drawings in which:

FIG. 2 is a sketch (on an enlarged scale) of part of the separator of FIG. 1;

FIG. 3 is a corresponding section through a second embodiment of separator;

FIG. 4 is a top plan view of FIG. 3; and

FIG. 5 is a sketch (on an enlarged scale) of part of a third embodiment of a separator.

Figure 1:
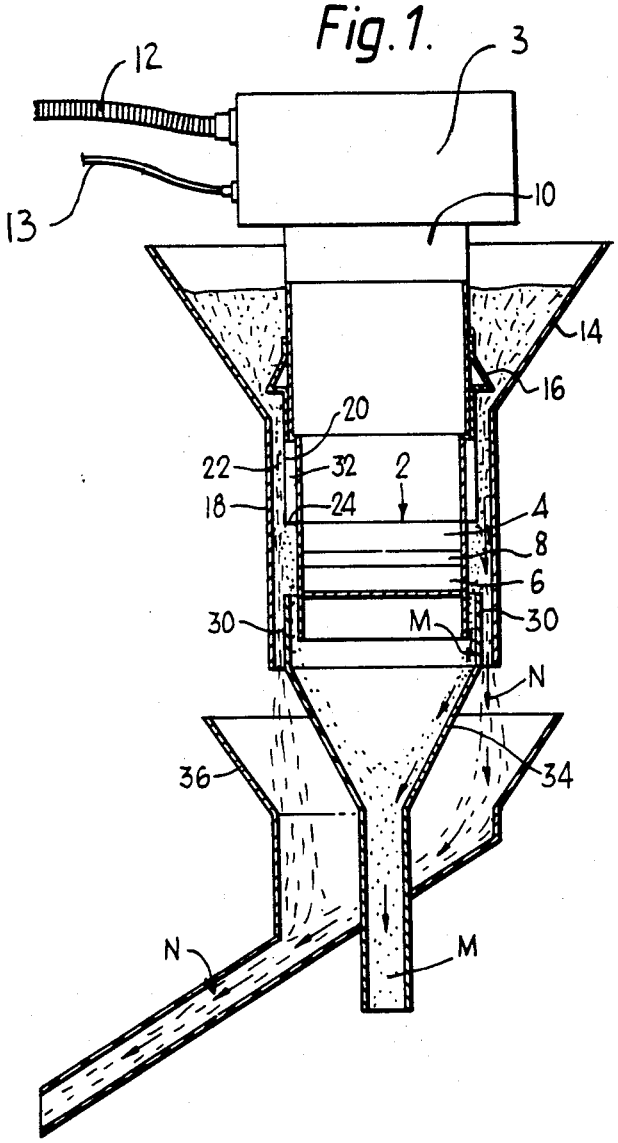
FIG. 1 is an elevation of an embodiment of magnetic separator in accordance with the invention.

Referring to FIGS. 1 and 2, the separator comprises an annular magnet member generally indicated at 2 comprising two superconductive magnetic coils 4 and 6 located co-axially one above the other and wound in opposite directions as illustrated by the arrows in FIG. 2. The two coils are positioned so as to leave a small gap which is shown at 8. This arrangement of the magnetic coils creates a strong, but virtually wholly radial, field over the depth of the gap.

The body 3 of the magnet 2, which is a cryogenic magnet, is supported by a plate 10 and helium and electric power enter the magnet at 12 and 13, respectively. The magnet body passes up through a conical feed trough 14 into which dry particulate material to be separated, is fed.

An annular choke cone 16 surrounds the body of the magnet 2 and extends across the outlet from the conical trough. The vertical position of the choke cone may be altered to adjust the feed of material from the trough.

The conical trough terminates in a downwardly extending skirt 18 defining, with an inner skirt 20 depending downwardly from but not necessarily movable with, the choke cone, an annular passage 22 for the particulate material. This passage has a sufficient length for the particles falling from the cone outlet, to achieve a desired velocity and help to achieve a smooth particle flow past the magnet.

The inner skirt 20 terminates at 24 at a position just above or adjacent to the upper edge of the gap 8 between the magnets.

As the material falls down the path 22 under the influence of gravity, the relatively magnetic particles on reaching the lower edge of skirt 20 are diverted along a path indicated by the line 26 radially inwardly towards the magnet 2. The non-magnetic material continues to fall vertically downwardly as indicated at 28 until it reaches a circular splitter member 30 which acts further to direct the stream of non-magnetic particles away from the stream of magnetic particles which moves down along the side of the magnet coil 6. As the magnetic field is virtually wholly radial, the magnetic particles are not retained by the magnet but rather can fall freely down along the side thereof.

It will be appreciated that as the separation occurs over a relatively small arc of the periphery of the magnet 2, separation of other material can take place simultaneously at other positions around the periphery of the magnet.

The width of the gap between the skirts 18 and 20 and the gap 32 between the skirt 20 and periphery of the magnet member 2 may be adjusted so as to take into account the quantity of magnetic material. If there is only a relatively small amount of magnetic material, then the gap can be relatively small and the field strength at the magnet face required will be less. If, however, there is a greater relative proportion of magnetic material, then in order to get proper separation, the gap 32 has to be larger and a higher field strength is required. It is believed that the gap can vary between say ½ and 2 cms., when the coil diameter is about 365 mm. and about 4 cms. when the diameter is about 250 cms. Basically, the greater the field force the greater the gap size may be. The coil thickness is about 9 cms., for a diameter of about 365 mm.

The flow of material through the path 22 may be assisted by pneumatic means and the pressure can be adjusted, as well as the size of gap 32 to enable the degree of separation to be varied.

The relatively magnetic particles M fall down the side of the lower magnet coil 6 within the circular path splitter 30 and enter the top of a funnel 34. The relatively non-magnetic particles N continue to fall in a relatively straight path outside the splitter 30 and fall within a second funnel 36 for discharge at a position separate from the relatively magnetic particles M. The diameter of the skirt 20 should be slightly greater than that of the splitter 30 to enable the non-magnetic particles to fall freely.

It will of course be appreciated that the particle mixture could be fed down within the coils rather than exterior thereto. In this case the relatively magnetic particles would be diverted outwardly towards the inside of the magnetic coils with the non-magnetic particles falling axially through the coils.

In one test, the two coils each had an outside diameter of 35 cms., an inside diameter of 29 cms., and a thickness of 8 cms. The coils were separated by a gap of 3.5 cms. The radial field strength was about 35,000 gauss. The inner skirt terminated 3.5 cms., above the centre of the magnetic field in the gap and the splitter was positioned 4 cms., below the field centre. There was a gap of 5 cms., between the choke cone and the side of the conical inlet trough. The gap between the inner and outer skirts was about 74 mms., and the gap between the inner skirt and the magnetic coils was about 2 cms. This apparatus was used for particle sizes of about 3 mm., of a feed having at least 75% of assorted silicates and 25% non-magnetics including 11 to 12% apatite, the rest being other non-magnetic material. The flow rate was about 7.2 tons per hour. About 50% of the magnetic particles were separated in a single pass raising the concentration of apatite in the non-magnetic portion to twice the concentration in the feed. A second pass was made increasing the concentration of apatite to more than 40%.

Referring to FIGS. 3 and 4, which illustrate an alternative embodiment of the separator, the apparatus comprises a magnet 2 similar to that described above with reference to FIG. 1, surrounded by an annular skirt member 40 forming a passage 42 which is closed at its top and open at its bottom and which is adjacent the periphery of the magnet 2. One or more pipes 44 are positioned to enter the passage 42 at the top and tangentially so that dry particulate material to be separated when blown or otherwise urged into the annular passage 42, flows spirally in the passage 42 around and down the length of the magnet 2. The relatively magnetic material is attracted towards the magnet adjacent the gap 8 between the two magnetic coils and is thus separated radially from the non-magnetic material which is urged towards the outside of the passage 42 against the skirt wall 40 by centrifugal force. As the material falls out from the bottom of the passage 42, the path of the magnetic material M can be separated by a splitter 46 from the path of the non-magnetic material N and the separated particles can readily be collected.

In a further arrangement illustrated in FIG. 5, the incoming stream of particles is diverted by a plate 48 so that its path diverges at a small angle from the axis of the magnet. This helps to carry the non-magnetic material away from the surface of the magnet in path 50 while the magnetic material is diverted towards the magnet as indicated at 52.

It will be appreciated that the separation could equally well take place horizontally provided that the particles were forced to flow past the magnet with sufficient force by, for example, pneumatic means. Also, the flow of particles in the embodiment described with reference to FIGS. 1, 2, and 5 can be assisted by pneumatic means.

We claim:

1. A method of separating relatively magnetic particles from relatively non-magnetic particles in a dry state comprising the steps of:

providing an adjustable, substantially vertical, flow of a mixture of the magnetic and non-magnetic particles, the particles moving under at least the influence of gravity, in a three-dimensional stream in a common path adjacent to, and at a predetermined distance away from, a magnet, producing a uniform strong magnetic field force with said magnet having a radial component produced over a relatively short proportion of said path of the particles, said radial component greatly exceeding an axial component of the magnetic field force, and said axial component exerting a force which is less than that of gravity, said path being a predetermined distance away from the magnet in a direction of said radial component of the magnetic field force, so that magnetic particles in said mixture of particles are diverted from said path toward said magnet but are not retained by it while particles in said mixture of particles not diverted toward said magnet continue in said path, and separating particles in said mixture of particles not diverted from said path toward said magnet from magnetic particles in said mixture of particles diverted from said path toward said magnet with a splitter located adjacent to said path of the particles below said relatively short proportion of said path over which said radial component of the magnetic field force is produced.

2. A method as claimed in claim 1 wherein said mixture is provided in a spiral path around and down adjacent said magnet.

3. A method as claimed in claim 1 in which all of said particles are caused to move in said path with the assistance of suction or gaseous pressure.

4. A method as claimed in claim 1 in which the pressure of the air, through which all of the particles fall, is reduced.

5. A method as claimed in claim 1 in which said magnet comprises a plurality of horizontally disposed magnetic coils wound in opposite directions and positioned one vertically above the other with a small gap therebetween.

6. A method as claimed in claim 1 in which said magnet is a high strength magnet having a field strength of about 20,000 gauss.

7. A magnetic separator for separating relatively magnetic particles from relatively non-magnetic particles in a dry state comprising;

a magnet so constructed as to produce a uniform radial magnetic field large compared with its axial field, means for supplying a mixture of magnetic and non-magnetic particulate material in a three-dimensional path adjacent to and at a predetermined distance from said magnet, the supply means and the magnet being arranged such that the material moves along its path under the influence of gravity, and the magnetic particles in said mixture are diverted from said path toward said magnet whereas the particles in said mixture which are not diverted toward said magnet continue substantially in said path, the position of said means for supplying said mixture of magnetic and non-magnetic particles being such that the magnetic particles are allowed to travel a distance sufficient to enable the particles to have a desired velocity, prior to entering the magnetic field, compatible with magnetic particles in said mixture being diverted by the radial field of said magnet by a distance sufficient to substantially separate particles in said mixture which are not diverted toward said magnet from magnetic particles in said mixture which are diverted toward said magnet into separate streams without said diverted magnetic particles being retained by said magnet, and the position and arrangement of said magnet being such that the particles in said mixture are subjected to magnetic force over only a relatively short portion of said path, and a splitter positioned and arranged with respect to said magnet so as to separate particles in said mixture which are not diverted toward said magnet from magnetic particles in said mixture which are diverted toward said magnet after the particles in said mixture have been magnetically separated.

8. A magnetic separator as claimed in claim 7 in which said means for supplying the particles comprises a hopper having an outlet orifice and inner and outer guide skirts to control the shape and direction of the flow of the mixture of magnetic and non-magnetic particulate material, said inner guide skirt extending to a distance of about three times the diameter of the outlet orifice of said hopper, and terminating adjacent the magnet.

9. A magnetic separator as claimed in claim 7 in which said means for supplying the particles includes a hopper having a wall and an annular outlet provided with an adjustable choke to control the flow rate.

10. A magnetic separator as claimed in claim 9 in which said choke and wall of said hopper define a conical path adjacent the outlet.

11. A magnetic separator as claimed in claim 7 wherein said mixture moves in a spiral path around and down adjacent said magnet, the means for supplying a mixture of magnetic and non-magnetic particulate material including a tangential inlet and a wall to constrain the movement of the particles in the desired path.

12. A magnetic separator as claimed in claim 7 wherein said magnet comprises at least two co-axial coils one positioned horizontally above the other, the at least two co-axial coils being wound in opposite directions.

13. A magnetic separator as claimed in claim 7 in which said magnet is a high strength magnet.

14. A magnetic separator as claimed in claim 13 in which said magnet is a superconducting magnet.

* * * * *